United States Patent [19]

Mucaro et al.

[11] Patent Number: 4,513,966

[45] Date of Patent: Apr. 30, 1985

[54] VEHICLE JUMP FOR A TOY VEHICLE GAME

[75] Inventors: Salvatore A. Mucaro, Maywood, N.J.; Neil Tilbor, Great Neck, N.Y.

[73] Assignee: CBS Inc., New York, N.Y.

[21] Appl. No.: 471,980

[22] Filed: Mar. 4, 1983

[51] Int. Cl.[3] ..... A63F 9/14

[52] U.S. Cl. ..... 273/68 B; 238/10 A; 238/10 F

[58] Field of Search ..... 273/86 R, 86 B; 238/10 A, 10 B, 10 C, 10 R, 10 F; 14/69.5; 446/444, 445, 441, 487, 168

[56] References Cited

U.S. PATENT DOCUMENTS

| | | | |
|---|---|---|---|
| 2,644,180 | 7/1953 | Eycleshimer | 14/69.5 |
| 3,480,210 | 11/1969 | Perrinjaquet | 46/43 |
| 3,814,021 | 6/1974 | McHenry | 46/1 K X |
| 4,383,688 | 5/1983 | Prehodka | 46/1 K X |

*Primary Examiner*—Mickey Yu

*Attorney, Agent, or Firm*—Richard M. Rabkin

[57] ABSTRACT

A toy vehicle jump includes a launching ramp and a landing ramp for an independently propelled toy vehicle, and an adjusting device for changing the orientation of one of the ramps from an operative position, in which a vehicle can negotiate the jump, to an inoperative position, in which the landing ramp does not accept a vehicle launched from the launching ramp. In a preferred embodiment of the vehicle jump, a jump structure, each comprising a launching ramp and a landing ramp, is provided for each of two vehicles travelling in adjacent lanes, and the adjusting device for each jump structure includes an actuator for increasing the angle of inclination of the respective landing ramp one step each time it is passed by a vehicle in the adjacent lane, until it reaches the inoperative position.

12 Claims, 4 Drawing Figures

VEHICLE JUMP FOR A TOY VEHICLE GAME

BACKGROUND OF THE INVENTION

1. Field of the Invention

This invention relates to a toy vehicle jump and, more particularly, to a jump for a toy vehicle game.

2. Description of the Prior Art

There are many types of toy vehicle games in which toy vehicles run in lanes layed out in various configurations. An extremely popular configuration is a Figure-8 layout in which two vehicles travel side-by-side around the layout.

To provide more interest, many such games use a jump where the tracks cross over each other at the middle of the Figure 8. Such a jump provides the game with more excitement than a simple over-under cross-over arrangement.

Toy vehicle jumps are well known in the art, both for vehicle games having a Figure-8 layout with a cross-over and for other vehicle games. Some prior art vehicle jumps are shown in U.S. Pat. Nos. 3,402,503 to M. I. Glass et al., 3,502,332 to T. Wolf, 3,858,875, to Nemuth et al., and 4,094,089 to Sano.

SUMMARY OF THE INVENTION

It is an object of the present invention to provide a vehicle jump that gives a toy vehicle game an additional element of excitement not present in prior art vehicle jumps.

It is another object of the present invention to provide a vehicle jump, as aforesaid, that is particularly applicable to a toy vehicle game having a track structure with two adjacent lanes along which respective vehicles are propelled.

In accordance with an aspect of the present invention, a vehicle jump for a toy vehicle game comprises jump means including launching ramp means for launching an independently propelled toy vehicle into the air and landing ramp means for accepting or receiving the launched toy vehicle, and repeatably actuable adjusting means for providing, with each actuation thereof, a step-by-step change in the inclination of at least one of the ramp means between an operative position, in which a toy vehicle can negotiate the jump means, and an inoperative position, in which the landing ramp means does not properly accept or receive a toy vehicle launched from the launching ramp means.

In accordance with another aspect of the present invention, a vehicle jump for a toy vehicle game comprises a main base member having first and second adjacent lanes, each of which is adapted for the passage of a toy vehicle therein, and the repeatably actuable adjusting means of the jump means associated with one of the lanes is actuable by a toy vehicle moving therepast in the other lane.

In a desirable embodiment of the invention, the first and second lanes have therein first and second jump means, respectively, each of which includes a launching ramp means for launching the respective independently propelled toy vehicle into the air and a landing ramp means for accepting the respective launched toy vehicle, and each of the first and second lanes is disposed for directing the toy vehicle therein past the second and first jump means, respectively. The vehicle jump also comprises first and second actuating means associated, respectively, with the first and second jump means for cooperating with the toy vehicles in the second and first lanes, respectively, to change the orientation of at least one of the ramp means of each of the jump means with the passage by the jump means of a toy vehicle in the adjacent lane.

The above, and other objects, features, and advantages of the present invention, will be apparent from the following detailed description of a preferred embodiment of the invention which is to be read in connection with the accompanying drawings and in which corresponding parts are identified by the same reference numerals in the several views.

DETAILED DESCRIPTION OF A PREFERRED EMBODIMENT

Figure 1:
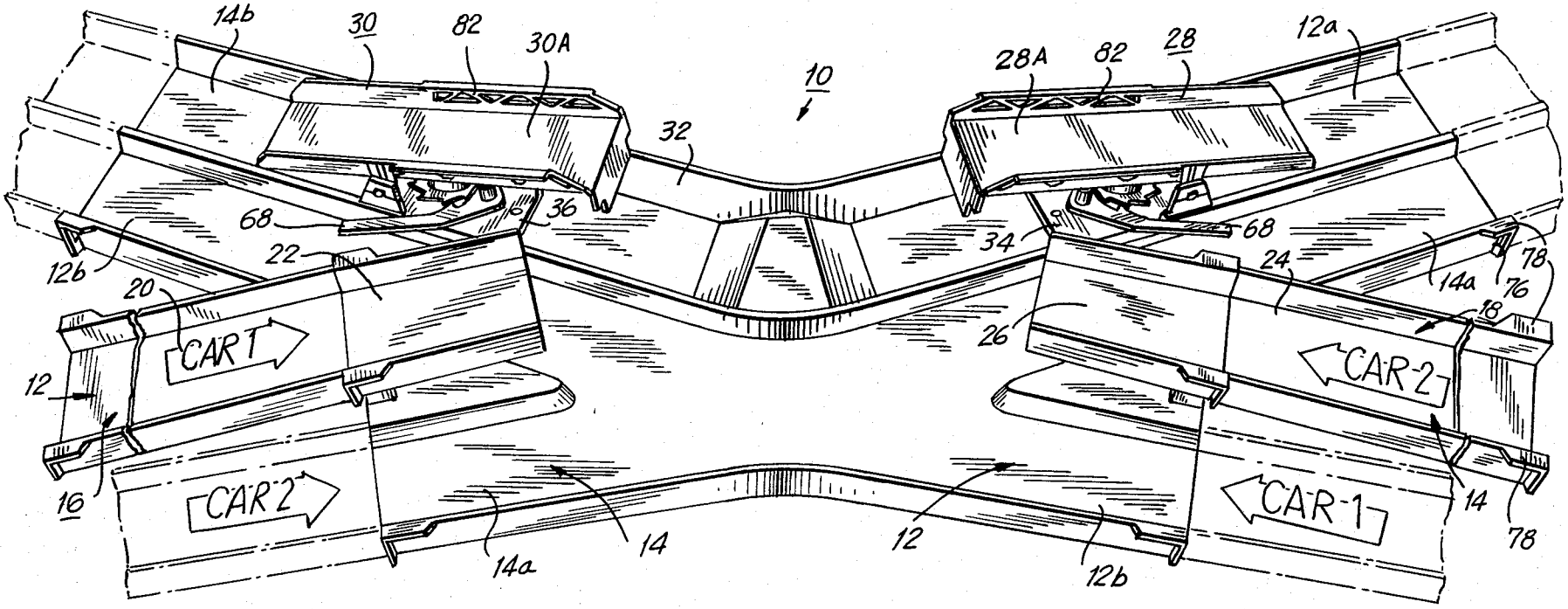
FIG. 1 is a perspective view of a vehicle jump in accordance with one embodiment of the present invention.

A vehicle jump 10 according to the present invention, as shown in FIG. 1, is particularly useful with a toy vehicle game having a dual track, Figure-8 layout, such as that shown in co-pending U.S. patent application Ser. No. 345,870, filed Feb. 4, 1982, now U.S. Pat. No. 4,423,871 and which is assigned to the assignee of the present invention. The vehicle jump 10 comprises a first lane 12 for a first toy vehicle shown schematically as CAR 1 and a second lane 14 for a second toy vehicle, shown schematically as CAR 2. The vehicle jump 10 mates with the track members of a vehicle game like that described in the above-mentioned patent application. Those track members extend the lanes 12 and 14 as shown by the phantom lines in FIG. 1. The first lane 12 comprises a first segment **12*a* and a second segment 12*b* disposed at an angle to the first segment 12*a*. The second lane 14 comprises a first segment 14*a* and a second segment 14*b* disposed at an angle to the first segment 14*a*. The first segments 12*a* and 14*a* are mutually adjacent, as are the second segments 12*b* and 14*b*. The track members of the game interconnect the segments of the lanes. The toy vehicles can be independently propelled in the lanes 12 and 14** by any suitable means. The propulsion system described in the above-identified patent application is particularly suited for use with the vehicle jump according to the present invention.

The vehicle jump 10 includes a first launching ramp means 16 in the first segment **12*a* of the first lane 12 and a second launching ramp means 18 in the second segment 14*b* of the second lane 14. Each of launching ramp means 16 and 18 may be formed in two parts, a jumping ramp and a jumping ramp extension. Thus, first launching ramp means 16 is shown to include a first jumping ramp 20 and a first jumping ramp extension 22, while second launching ramp means 18 includes a second jumping ramp 24 and a second jumping ramp extension 26. The jumping ramps 20 and 24 are identical, as are the jumping ramp extensions 22 and and 26. The vehicle jump 10 also includes a first landing ramp means 28 and a second landing ramp means 30 associated with first and second launching ramp means 16 and 18, respectively. Together the respective launching ramp means and landing ramp means comprise first and second jump means that the toy vehicles must negotiate each time they make a circuit of the Figure-8 track. Moreover, the first jump means is in the first segment 12***a* of the first lane 12 so that the toy vehicle in the first lane 12 vaults the second segment 12*b* thereof. The second jump means is in the second segment 14*b* of the second lane 14 so that the toy vehicle in the second lane 14 vaults the first segment 14*a* thereof.

Figure 2:
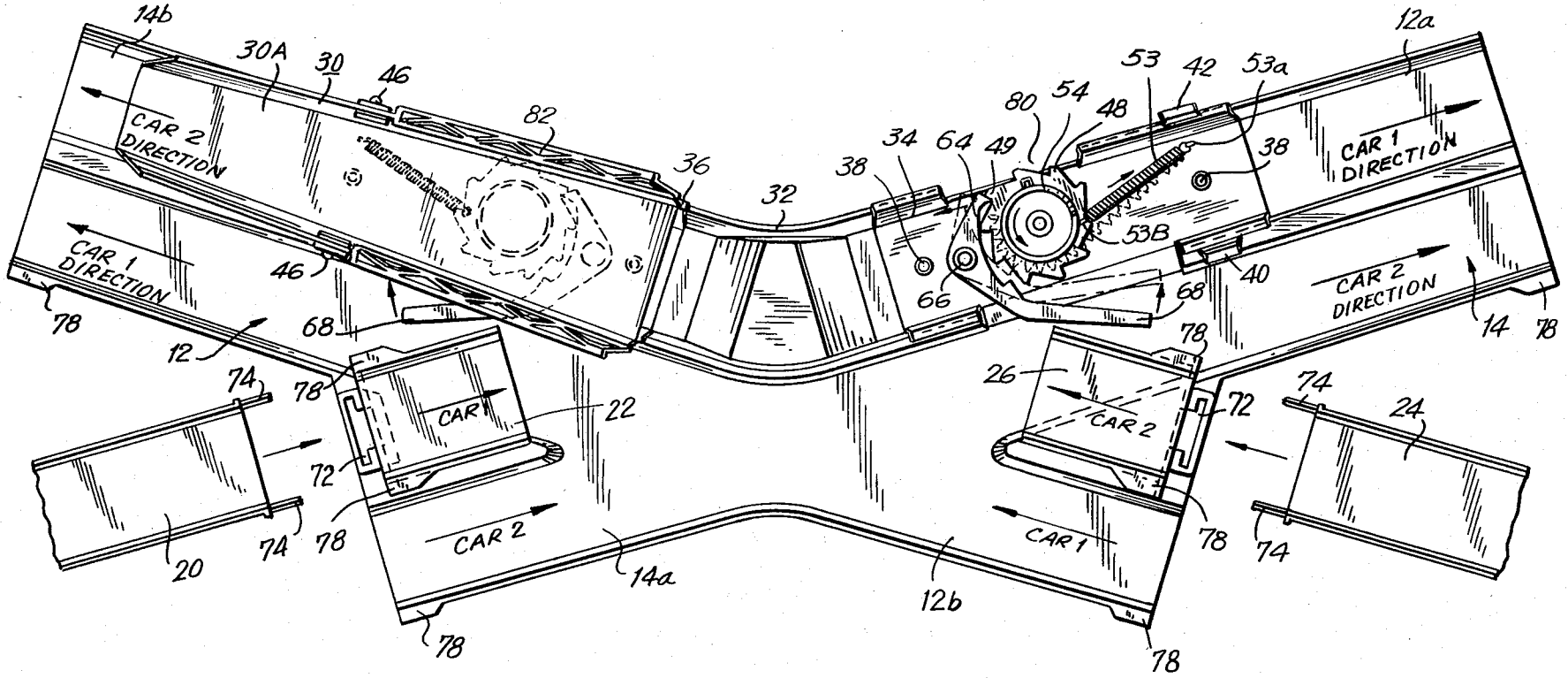
FIG. 2 is a plan view of the vehicle jump shown in FIG. 1, with one of the landing ramps thereof removed to show details of an actuation means included in the vehicle jump.
Figure 3:
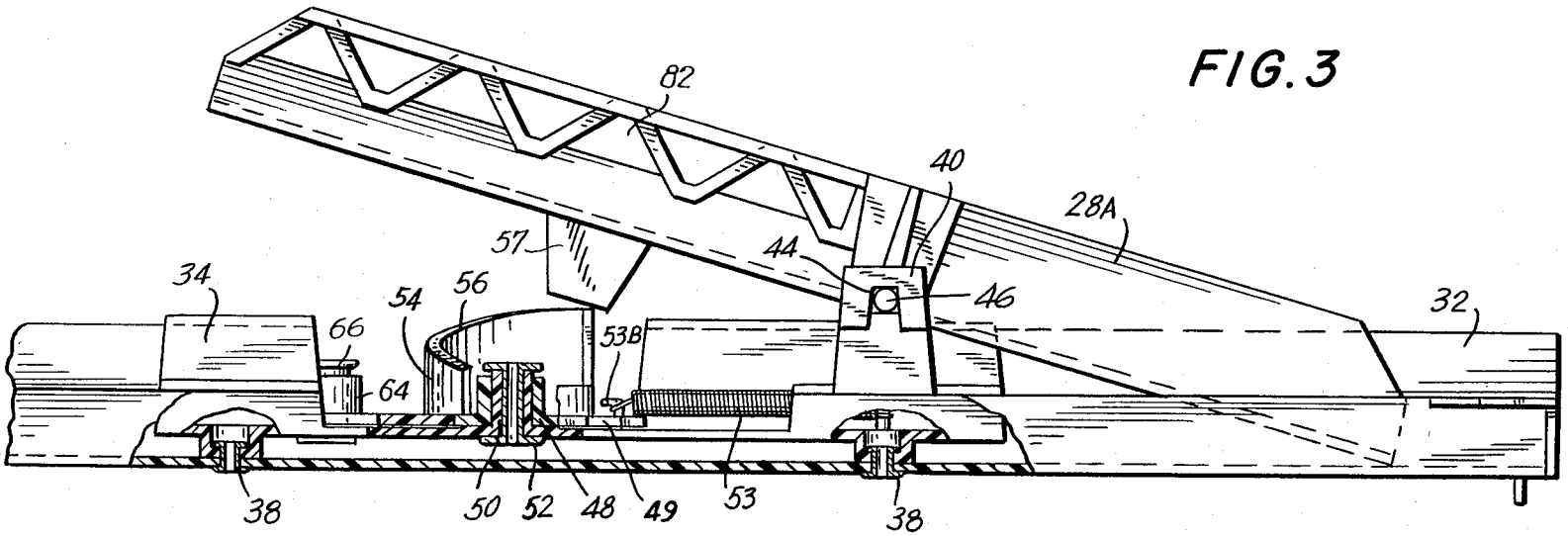
FIG. 3 is a side elevation, partly in section, showing details of a landing ramp and the actuation means of the vehicle jump shown in FIG. 1.

The first and second landing ramp means 28 and 30 comprise, respectively, first and second landing ramps 28A and 30A that are mounted for pivotal movement, a feature of the present invention best seen in FIGS. 2 and 3. The vehicle jump 10 includes a main base member 32 which may be molded in one piece from a suitable plastic material. A pair of landing ramp bases 34 and 36 are secured to the main base 32 by eyelets 38. The landing ramps 28A and 30A mount to the landing ramp bases 34 and 36, respectively. The landing ramp bases 34 and 36 are mirror-images, so that a description of the landing ramp base 34 will also make clear the features and configuration of the landing ramp base 36.

FIG. 2 depicts the vehicle jump 10 with the landing ramp 28A "removed" to illustrate better the landing ramp base 34. The landing ramp base 34 has a pair of standards 40 and 42 with mutually coaxial openings 44 therethrough. The landing ramp 28A has a pair of pivot pins 46 that fit into the openings 44 to pivotally mount the landing ramp 28A to the landing ramp base 34. FIG. 2 illustrates the location of the pivot pins 46 on landing ramp 30A. A ratchet 48 is rotatably mounted on a boss 50 raised from the landing ramp base 34. An elongated eyelet 52 holds the ratchet 48 on the boss 50. The ratchet 48 includes a flat toothed portion 49. A ratchet spring 53 stretches between a first hook 53A on the landing ramp base 34 and a second hook 53B on the flat portion 49 of the ratchet 48. The ratchet 48 includes a central cylindrical portion 54 extending from the flat toothed portion 49 and terminating in a spiral cam 56 having an inclined upper edge. The landing ramp 28A includes a projection 57 on its underside that rests on the inclined edge of cam 56. A toothed pawl or escapement 64 is pivotally mounted on the landing ramp base 34 at a pivot 66. The pawl 64 includes an integral handle 68 that has a rest position (shown in solid lines in FIG. 2) and an actuated position (shown in phantom lines in FIG. 2). The pawl 64 is suitably biased about the pivot 66 for example, as by a torsion spring (not shown), so that the handle 68 is biased toward the rest position.

Figure 4:
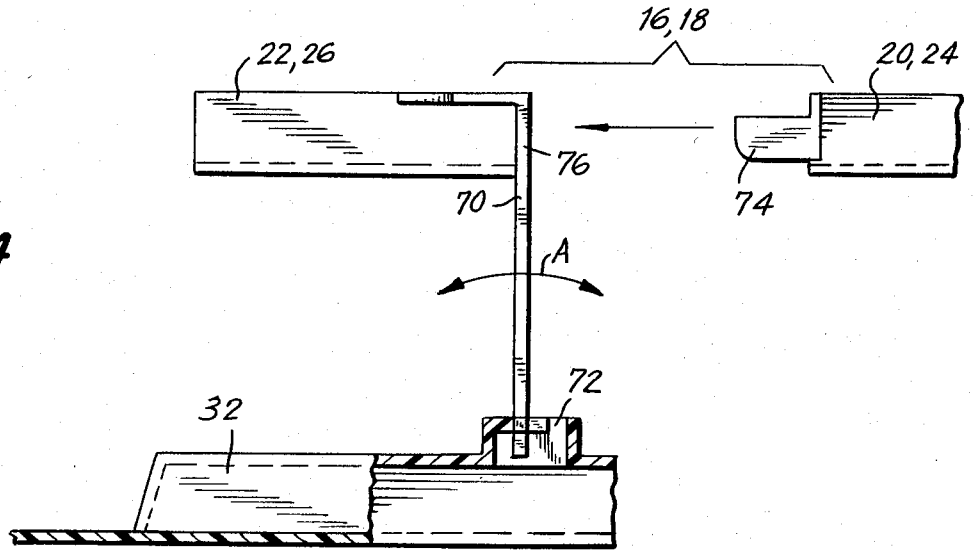
FIG. 4 is a detail of the assembly of a launching ramp included in the vehicle jump shown in FIG. 1.

FIG. 4 shows the assembly of the launching ramp means 16 and 18. Each of jumping ramp extensions 22 and 26 includes an arm 70 that removably mounts on the main base member 32 at a mounting recess 72. The lower end of the arm 70 fits into the mounting recess 72 for limited rotation in the direction of arrow A. Tabs 74 on one end of the jumping ramp 20 or 24 fit into slots 76 in lateral bulges 78 formed in the jumping ramp extensions 22 and 26 (see FIG. 2) to removably secure the jumping ramps 20 and 24 to the respective jumping ramp extensions 22 and 26. Similar slots are formed in the main base member 32 at the ends of the lanes 12 and 14 to comprise attachment means for securing together the track members of the game and the main base member 32. Where the thickness of the main base member 32 is insufficient for slots, bulges 78 are formed in the main base member 32. The other end of the jumping ramps 20 and 24 of course also include similar attachment means.

In operation the vehicle jump is assembled into a toy vehicle game like that shown in the above-identified application. In a dual-track, Figure-8 layout, two toy vehicles have the paths indicated in FIGS. 1 and 2 for "CAR 1" and "CAR 2". The ratchet 48 is turned, by hand, clockwise as seen in FIG. 2, through a laterally opening slot 80 formed in the landing ramp base 34 (see FIG. 2). As the ratchet 48 is turned, the ratchet spring 53 winds around the cylindrical portion 54. The ratchet spring 53, which is a tension spring, is thus stretched to bias the ratchet 48 in the other angular direction. As the toy vehicle in each lane repeatably passes the handle 68 on a pawl 64 pivoted in the adjacent lane, the vehicle repeatedly moves the handle 68 to its actuated position (shown in phantom lines for one of the handles 68 in FIG. 2). The pawl 64, the ratchet 48 and the ratchet spring 53 comprise an escapement mechanism that limits the rotation of the ratchet 48 by the spring 53 to a step-by-step action, with the ratchet 48 rotating one step each time the handle 68 is actuated. As best seen in FIG. 3, that rotation, because of the cam 56, raises the respective landing ramps 28A and 30A in increments. When a ratchet 48 reaches the angular positon shown in FIG. 3, the angle of inclination of the landing ramp 28A or 30A will be sufficient to cause the raised end to interfere with a vehicle launched from the respective launching ramp means 16 or 18. The landing ramp 28A or 30A will thus have reached an inoperative position, in which it does not properly accept or receive a toy vehicle launched from a respective launching ramp means.

The ratchets 48 are thus biased toward a first angular position in which the landing ramps 28A and 30A are in their inoperative or relatively steeply inclined inclined positions. When the game begins, the ratchets 48 are turned by hand and held by the respective pawls 64 to place both landing ramps 28A and 30A in their operative or less inclined positions, in which the toy vehicles can negotiate the jump means; that is, the angles of inclination of the operatively positioned landing ramps are sufficiently low to accept a toy vehicle launched from the respective launching ramp means. The repeatably actuable adjusting means then provide, with each actuation thereof, a step-by-step change in the inclination of the landing ramps toward their inoperative positions. The adjusting means in the present embodiment includes the actuating means comprising the handles and the escapement mechanisms, which comprise the ratchets, the ratchet springs and the pawls. As described above, each handle extends into an adjacent lane for contact by a toy vehicle passing the handle to move the handle from its rest position, in which the pawl is positioned to prevent rotation of the ratchet toward its first angular position, to its actuated position, in which the pawl is positioned to permit rotation of the ratchet one step toward its first angular position. Thus, after each vehicle passes by the handle of the other vehicle's jump means a predetermined number of times, the other vehicle will no longer be able to negotiate the jump means.

Thus, the vehicle jump 10 of the present invention adds an element of excitement and suspense previously lacking in toy vehicle games in which the cars merely travel around the layout or have jumps that do not change their angles of inclination. The vehicle jump of the present invention can also have additional features that add to the excitement and realism of the game. For example, the landing ramps 28A and 30A have simulated structural trusses 82 that add realism to the game. For another example, a flag can be mechanically linked to the landing ramps and raised and lowered with it, thus acting as an indicating means to tell each player how close the landing ramp for his or her vehicle is to the point at which it can no longer negotiate the jump.

Although the present invention has been described in connection with one illustrative embodiment, shown in the accompanying drawings and described in detail herein, it is to be understood that the present invention is not limited to that precise embodiment. Various changes and modifications other than those specifically mentioned, may be made in that embodiment by one skilled in the art without departing from the scope and spirit of the invention. For example, the inclination of the launching ramp means, rather than the landing ramp, could be altered, the inclination of both could be altered, or a passing vehicle in an adjacent lane could alter the orientation of the launching or landing ramp means in some fashion other than by a change of inclination. Therefore, it is intended that the scope of the present invention is defined solely by the appended claims.

What is claimed is:

1. A vehicle jump for a toy vehicle game having two toy vehicles, said vehicle jump comprising jump means including launching ramp means for launching an independently propelled toy vehicle into the air and landing ramp means for accepting a toy vehicle launched from said launching ramp means; repeatably actuable adjusting means for providing with each actuation thereof a step-by-step change in the inclination of said landing ramp means between an operative position, wherein a toy vehicle can negotiate said jump means, and an inoperative position, wherein said landing ramp means does not properly accept a toy vehicle launched from said launching ramp means; and a main base member defining two lanes thereon, one for each toy vehicle, wherein:

said landing ramp means includes a landing ramp pivotally mounted to said main base member for movement between said operative and inoperative positions;

said landing ramp in said operative position has an angle of inclination sufficiently low to accept a toy vehicle launched from said launching ramp and in said inoperative position has an angle of inclination steep enough to interfere with a toy vehicle launched from said launching ramp;

at least one of said lanes includes said jump means; and said adjusting means includes actuating means for cooperating with a toy vehicle in the other said lane as the vehicle passes said landing ramp to change the inclination of said landing ramp one step with each passage thereby of the vehicle in the other said lane.

2. A vehicle jump as in claim 1 wherein:

said actuating means includes a handle and an escapement mechanism comprising a rotatable ratchet, a ratchet spring biasing said rotatable ratchet toward a first angular position and a pivotable pawl;

said rotatable ratchet includes ratchet teeth and a cam cooperating with said landing ramp for changing the inclination of said landing ramp with rotation of said ratchet;

said landing ramp is in said inoperative position when said ratchet is in said first angular position;

said pivotable pawl includes pawl teeth for engaging said ratchet teeth to hold said ratchet against the force of said ratchet spring; and said handle is secured to said pawl for extending into said other lane for contact by a toy vehicle in said other lane passing said handle to move said handle from a rest position, wherein said pawl is positioned to prevent rotation of said ratchet toward said first angular position, to an actuated position, wherein said pawl is positioned to permit rotation of said ratchet one step toward said first angular position said handle being biased toward said rest position.

3. A vehicle jump as in claim 2 wherein:

said landing ramp means includes a landing ramp base having said landing ramp and said actuating means mounted thereon;

said ratchet includes a flat toothed portion and a cylindrical portion extending from said toothed portion and terminating in said cam; and said ratchet spring comprises a tension spring extending between a first hook on said landing ramp base and a second hook on said toothed portion of said ratchet; and said ratchet spring is adapted to be wound around said cylindrical portion and thereby stretched to bias said ratchet toward said first angular position.

4. A vehicle jump as in claim 3 wherein said ratchet teeth are accessible for manual rotation of said ratchet against the force of said ratchet spring, whereby said landing ramp can be returned to said operative position from said inoperative position.

5. A vehicle jump for a toy vehicle game comprising:

a main base member having first and second adjacent lanes, each said lane being adapted for the passage of a toy vehicle therein;

jump means in at least one of said lanes, said jump means including a launching ramp means for launching an independently propelled toy vehicle into the air and a landing ramp means for accepting a vehicle launched from said launching ramp means, wherein the other said lane is disposed for directing the toy vehicle therein past said jump means;

actuating means associated with said jump means for cooperating with a toy vehicle in said other lane to change the orientation of at least one of said ramp means of said jump means with the passage of a toy vehicle thereby in the adjacent lane.

6. A vehicle jump as in claim 5 further comprising:

first and second said jump means in said first and second lanes, respectively, wherein each said first and second lane is disposed for directing the toy vehicle therein past said second and first jump means, respectively;

first and second actuating means associated, respectively, with said first and second jump means for cooperating with toy vehicles in said second and first lanes, respectively, to change the orientation of at least one of said ramp means of each said jump means with the passage thereby of a vehicle in the adjacent lane.

7. A vehicle jump as in claim 6 wherein:

each said launching ramp means comprises a pivotally mounted landing ramp;

each said actuating means is adapted to provide a repeatable step-by-step change in the inclination of said respective landing ramp with each passage thereby of a toy vehicle in the adjacent lane; and said change in orientation comprises a change in the inclination of each said landing ramp from an operative position, wherein said landing ramp has an angle of inclination sufficiently low to accept a toy vehicle launched from said respective launching ramp, to an inoperative position, wherein said landing ramp has an angle of inclination steep enough to interfere with a toy vehicle launched from said respective launching ramp.

8. A vehicle jump as in claim 7 wherein:

each said actuating means includes a handle and an escapement mechanism comprising a rotatable ratchet, a ratchet spring biasing said rotatable ratchet toward a first angular position, and a pivotable pawl;

each said rotatable ratchet includes ratchet teeth and a cam for changing the inclination of said respective landing ramp with rotation of said ratchet;

each said landing ramp is in said inoperative position when said respective ratchet is in said first angular position;

each said pivotable pawl includes pawl teeth for engaging said ratchet teeth to hold said respective ratchet against the force of said ratchet spring; and each said handle is secured to said respective pawl for extending into the adjacent lane for contact by a toy vehicle in said adjacent lane passing said handle to move said handle from a rest position, wherein said pawl is positioned to prevent rotation of said respective ratchet toward said first angular position to an actuated position, wherein said pawl is positioned to permit rotation of said respective ratchet one step toward said first angular position, each said handle being biased toward said rest position.

9. A vehicle jump as in claim 7 further including attachment means for securing said base member to the track members of a toy vehicle game, wherein said track members are adapted to comprise extensions of said lanes.

10. A vehicle jump as in claim 9 wherein each said launching ramp means includes a jumping ramp and a jumping ramp extension, wherein:

each said jumping ramp extension is removably mounted to said main base member and one end of respective said jumping ramp; and each said jumping ramp includes said attachment means at the other end thereof.

11. A vehicle jump as in claim 9 wherein:

each said lane comprises a first segment and a second segment disposed at an angle thereto, said first segments and said second segments being mutually adjacent;

said first and second jump means are disposed in said first and second segments, respectively, for vaulting the toy vehicles in said first and second lanes over said second and first segments thereof, respectively; and each said handle is secured to said respective pawl for extending into said adjacent segment.

12. A vehicle jump as in claim 11 further comprising track menbers of a vehicle game for cooperating with and interconnecting said segments of said lanes.

* * * * *